US007055413B1

(12) United States Patent
Wang

(10) Patent No.: US 7,055,413 B1
(45) **Date of Patent: *Jun. 6, 2006**

(54) PAIR OF PLIERS FOR SNAP RINGS

(76) Inventor: Tien-Shui Wang, No. 232, Tou Tan Road, Sha Lu Town, Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/906,835

(22) Filed: Mar. 8, 2005

(51) Int. Cl.
*B25B 7/02* (2006.01)

(52) U.S. Cl. ..... 81/302; 29/229

(58) Field of Classification Search ..... 81/302, 81/421, 422, 423, 185.1
See application file for complete search history.

(56) References Cited

U.S. PATENT DOCUMENTS

| | | | | | |
|---|---|---|---|---|---|
| 2,553,620 | A * | 5/1951 | Yeazell | 81/302 |
| 3,662,449 | A * | 5/1972 | Hashimoto | 29/229 |
| 4,280,265 | A * | 7/1981 | Murphy | 29/229 |
| 4,625,379 | A * | 12/1986 | Anderson | 29/229 |
| 4,793,224 | A * | 12/1988 | Huang | 81/302 |
| 5,483,732 | A * | 1/1996 | Wang | 29/229 |
| 5,515,587 | A * | 5/1996 | Pool | 29/229 |
| 5,542,167 | A * | 8/1996 | Nakamoto | 29/229 |
| 5,826,467 | A * | 10/1998 | Huang | 81/302 |
| 6,257,105 | B1 * | 7/2001 | Lin | 81/302 |
| 6,282,995 | B1 * | 9/2001 | Lin | 81/423 |
| 6,792,837 | B1 * | 9/2004 | Battistone | 81/302 |

* cited by examiner

*Primary Examiner*—David B. Thomas
*Assistant Examiner*—Robert Scruggs
(74) *Attorney, Agent, or Firm*—Alan D. Kamrath; Nikolai & Mersereau, P.A.

(57) ABSTRACT

A pair of pliers is provided for snap rings. The pair of pliers includes two handles pivotally connected with each other, a spring compressed between the handles and two jaws detachably installed on the handles. Each jaw includes a first operative portion, a first tip extending from the first operative portion, a second operative portion extending from the first operative portion and a second tip extending from the second operative portion. The size of the second tip is different from that of the first tip.

14 Claims, 15 Drawing Sheets

PAIR OF PLIERS FOR SNAP RINGS

BACKGROUND OF INVENTION

1. Field of Invention

The present invention relates to a pair of pliers for snap rings.

2. Related Prior

As discussed in U.S. Pat. No. 6,257,105, BACKGROUND OF THE INVENTION, referring to FIG. 1 thereof a pair of pliers is provided for snap rings (or "C-rings"). The pair of pliers includes two handles 1 and two jaws 6 secured to the handles 1 by pins 11. Each jaw 6 includes a straight operative portion from which a tip extends.

As discussed in U.S. Pat. No. 6,257,105, BACKGROUND OF THE INVENTION, referring to FIG. 2 thereof, a pair of pliers is provided for snap rings. The pair of pliers includes two handles 1 and two jaws 7 secured to the handles 1 by pins 11. Each jaw 7 includes a bent operative portion from which a tip extends.

The pair of pliers shown in FIG. 1 of U.S. Pat. No. 6,257,105 is preferred sometimes, and the pair of pliers shown in FIG. 2 of U.S. Pat. No. 6,257,105 is preferred in other situations. Since the jaws 6 and 7 are secured to the handles 1, the jaws 6 cannot be replaced with the jaws 7, and vice versa. To have two different pairs of jaws 6 or 7, a user has to buy two identical pairs of handles 1. This is not economical. Moreover, since each jaw 6 or 7 includes only one tip, it can only engage with snap rings that include apertures of a corresponding size.

According to U.S. Pat. No. 6,257,105, DETAILED DESCRIPTION OF THE INVENTION, referring to FIGS. 3 through 6 thereof, a pair of pliers is provided for snap rings. The pair of pliers includes two handles 1 and two jaws 2 connected with the handles 1 in a detachable manner. Each jaw 2 includes a straight operative portion 22 from which a tip extends and a bent operative portion 23 from which a tip extends. The straight operative portions 22 can be replaced with the bent operative portions 23 and vice versa. However, each jaw 2 includes identical tips so that each jaw 2 can only engage with snap rings that include apertures of a corresponding size.

The present invention is therefore intended to obviate or at least alleviate the problems encountered in the prior art.

SUMMARY OF INVENTION

According to the present invention, a pair of pliers is provided for snap rings. The pair of pliers includes two handles pivotally connected with each other, a spring compressed between the handles and two jaws detachably installed on the handles. Each jaw includes a first operative portion, a first tip extending from the first operative portion, a second operative portion extending from the first operative portion and a second tip extending from the second operative portion. The size of the second tip is different from that of the first tip.

The primary advantage of the pair of pliers of the present invention is that it can be used for two different sizes of snap rings.

Other advantages and novel features of the present invention will become more apparent from the following detailed description in conjunction with the attached drawings.

BRIEF DESCRIPTION OF DRAWINGS

The present invention will be described through detailed illustration of embodiments referring to the drawings.

DETAILED DESCRIPTION OF EMBODIMENTS

Figure 1:
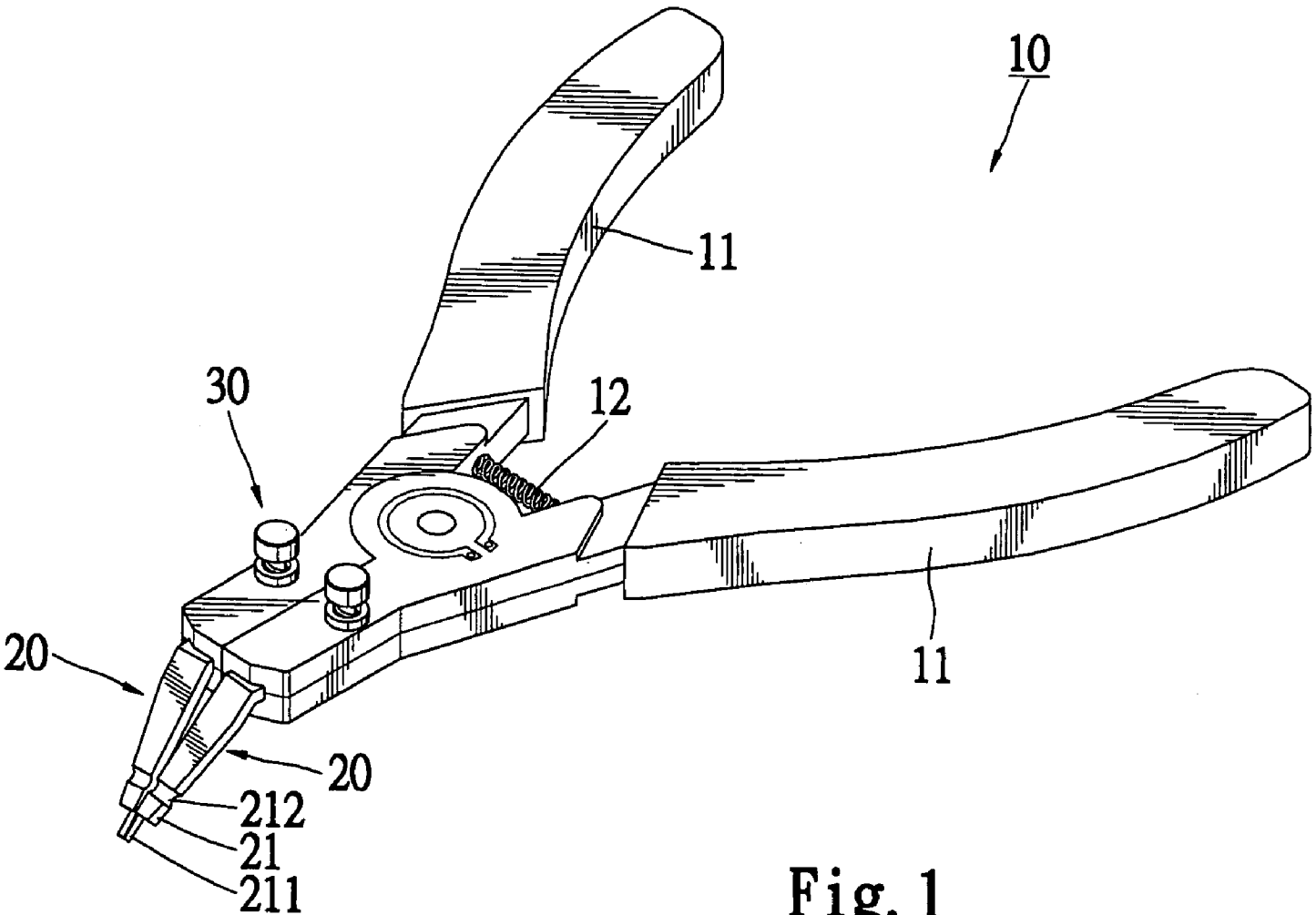
FIG. 1 is a perspective view of a pair of pliers for snap rings according to a first embodiment of the present invention.

Referring to FIG. 1, according to a first embodiment of the present invention, a pair of pliers 10 for snap rings includes two handles 11 pivotally connected with each other, a spring 12 compressed between the handles 11 and two jaws 20 installed on the handles 11 by quick release devices 30.

Figure 2:
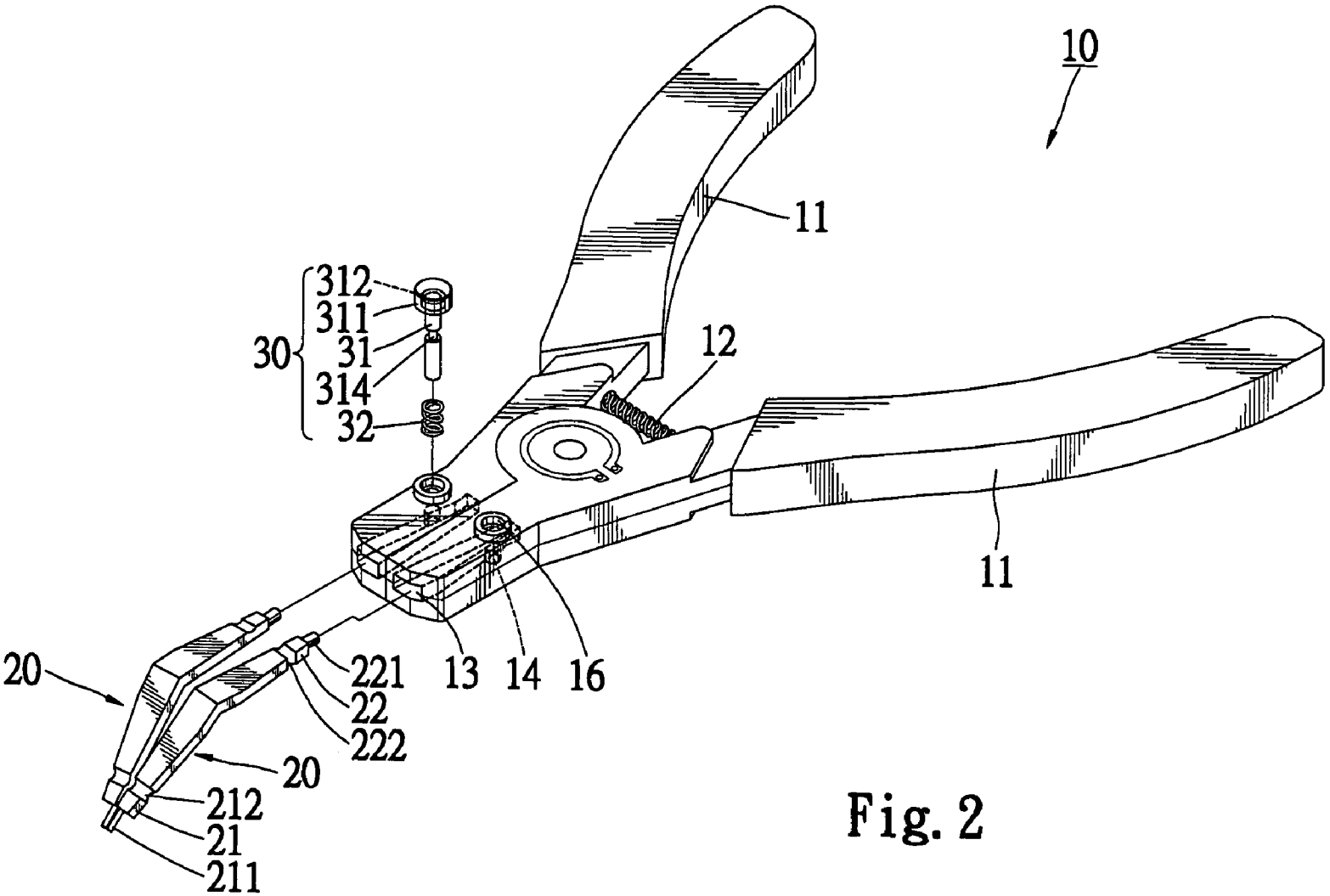
FIG. 2 is an exploded view of the pair of pliers shown in FIG. 1.

Referring to FIG. 2, each handle 111 defines a pocket 13 and an aperture 14 communicated with the pocket 13. A wall 16 is formed on each handle 111 around an end of the aperture 14.

Each jaw 20 includes a first operative portion 21 and a second operative portion 22 with an obtuse angle defined between the first operative portion 21 and the second operative portion 22. The first operative portion 21 includes a tip 211 formed at an end and a neck 212 formed near the end. The second operative portion 22 includes a tip 221 formed at an end and a neck 222 formed near the end. The size of the tip 211 is different from that of the tip 221. The second operative portions 22 are inserted in the pockets 13 so that the first operative portions 21 are exposed for use.

Figure 4:
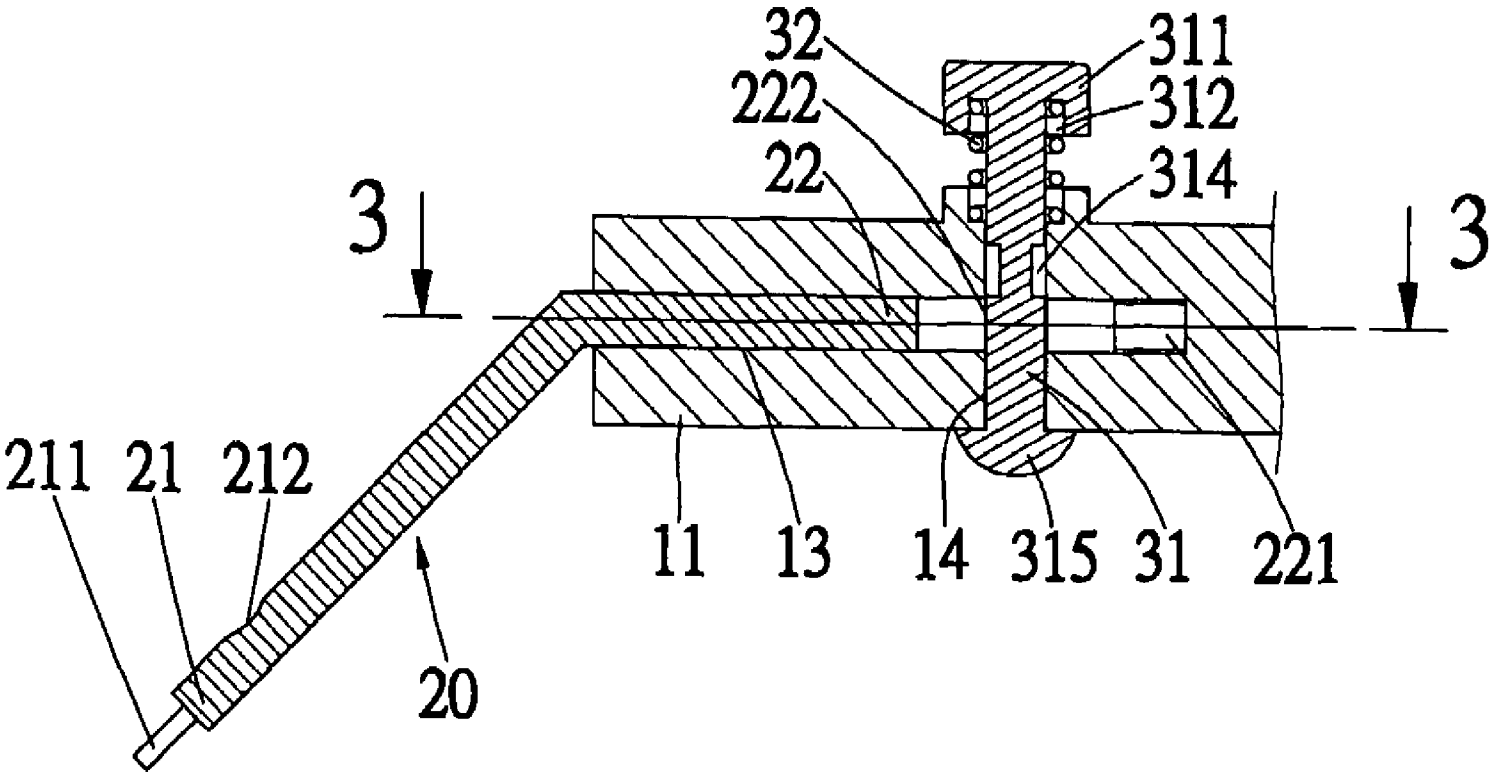
FIG. 4 is a cross-sectional view of the pair of pliers taken along a line 4—4 in FIG. 3.

Each quick release device 30 includes a pin 31 and a spring 32. The pin 31 includes a first head 311 that is made before the pin 31 is inserted in the aperture 14 and a second head 315 that is formed after the pin 31 is inserted in the aperture 14 (FIG. 4). Thus, the pin 31 is kept on the handle 11. The first head 311 defines an annular groove 312. The pin 31 includes a waist 314.

The spring 32 is put around the pin 31 before the pin 31 is inserted in the aperture 14. The spring 32 is compressed between the first head 311 and the handle 11. An end of the spring 32 is inserted in the annular groove 312 while an opposite end of the spring 32 is inserted in the wall 16.

Figure 3:
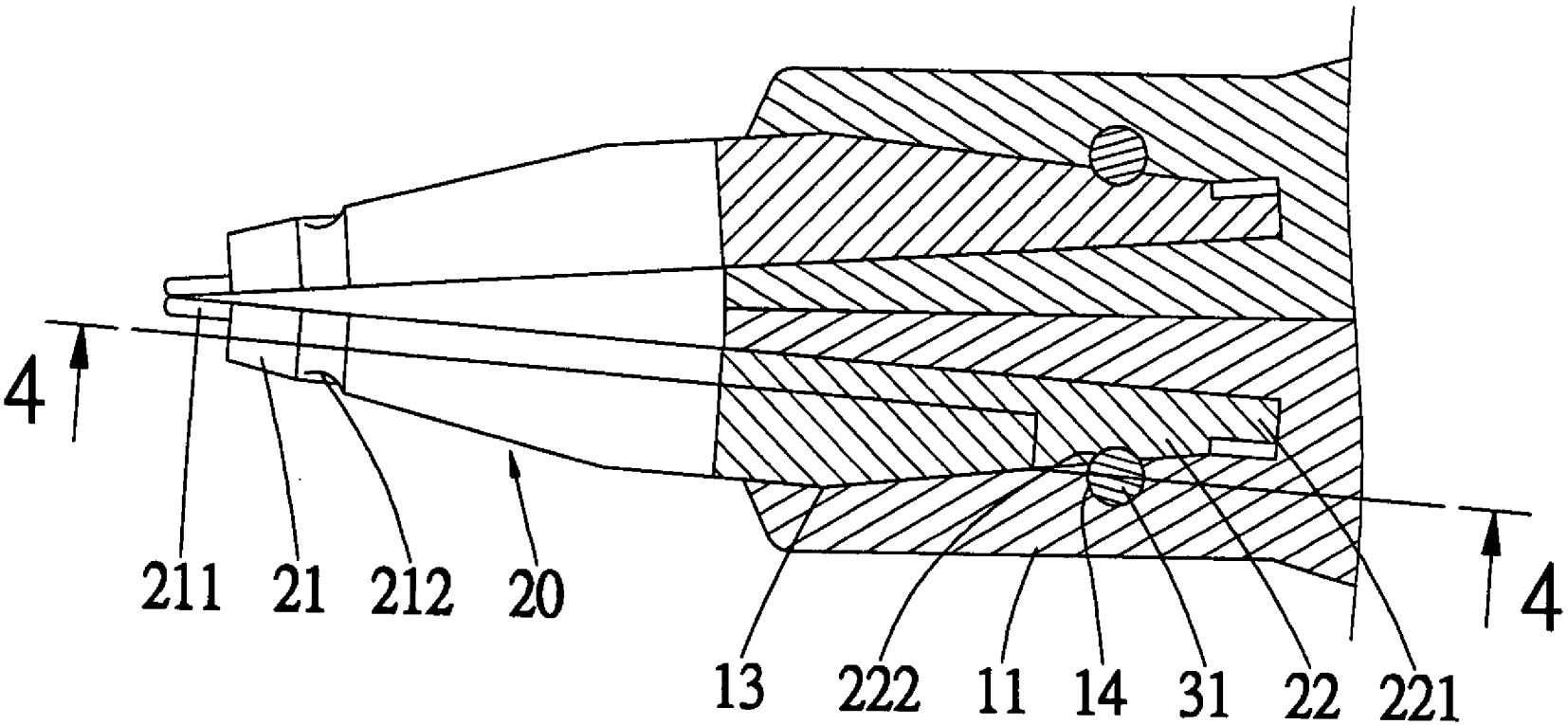
FIG. 3 is a cross-sectional view of the pair of pliers taken along a line 3—3 in FIG. 4.

Referring to FIGS. 3 and 4, the pin 31 is engaged with the neck 222 so that the second operative portion 22 is kept in the pocket 13.

Figure 5:
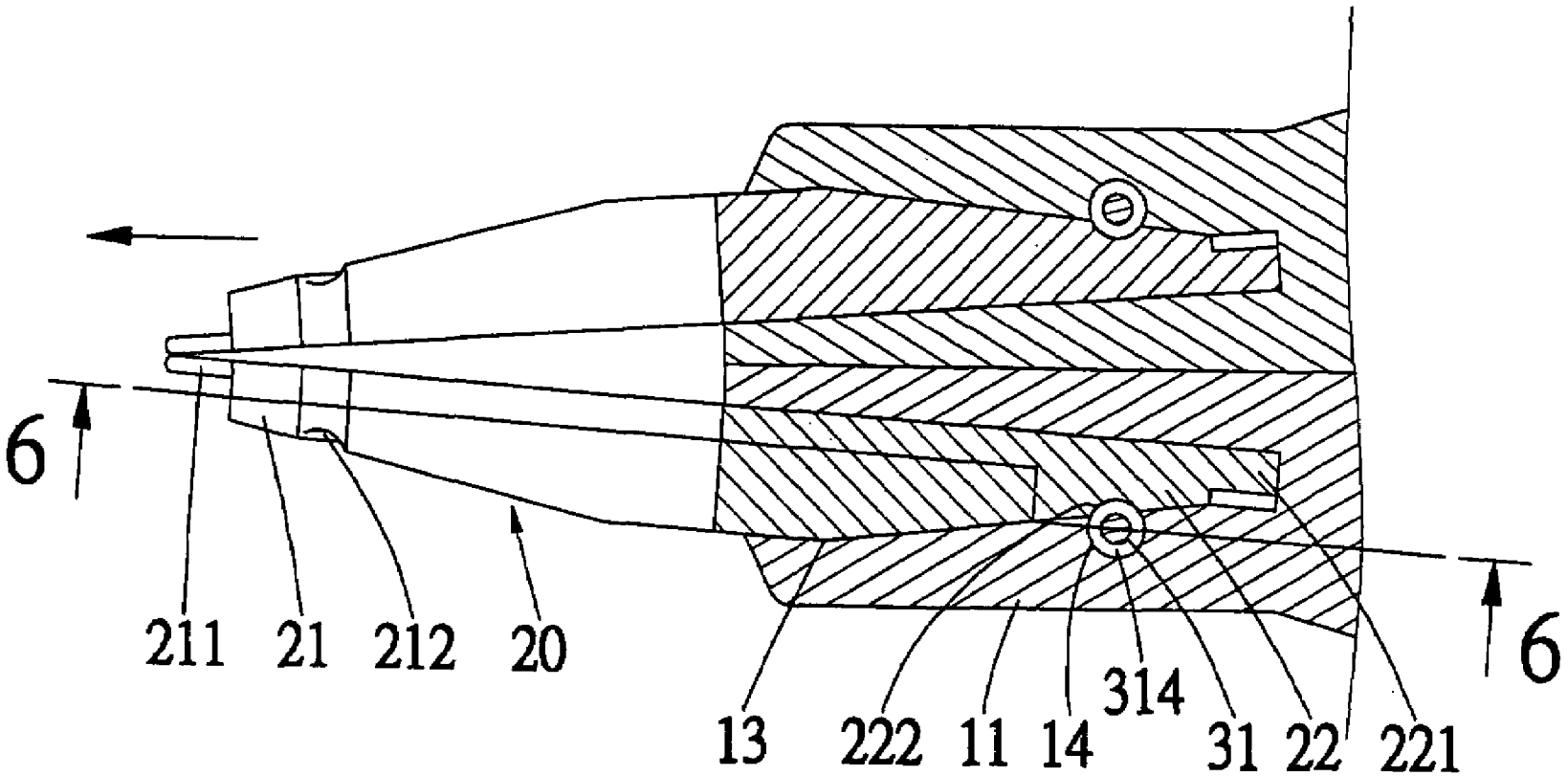
FIG. 5 is a cross-sectional view of the pair of pliers taken along a line 5—5 in FIG. 6.
Figure 6:
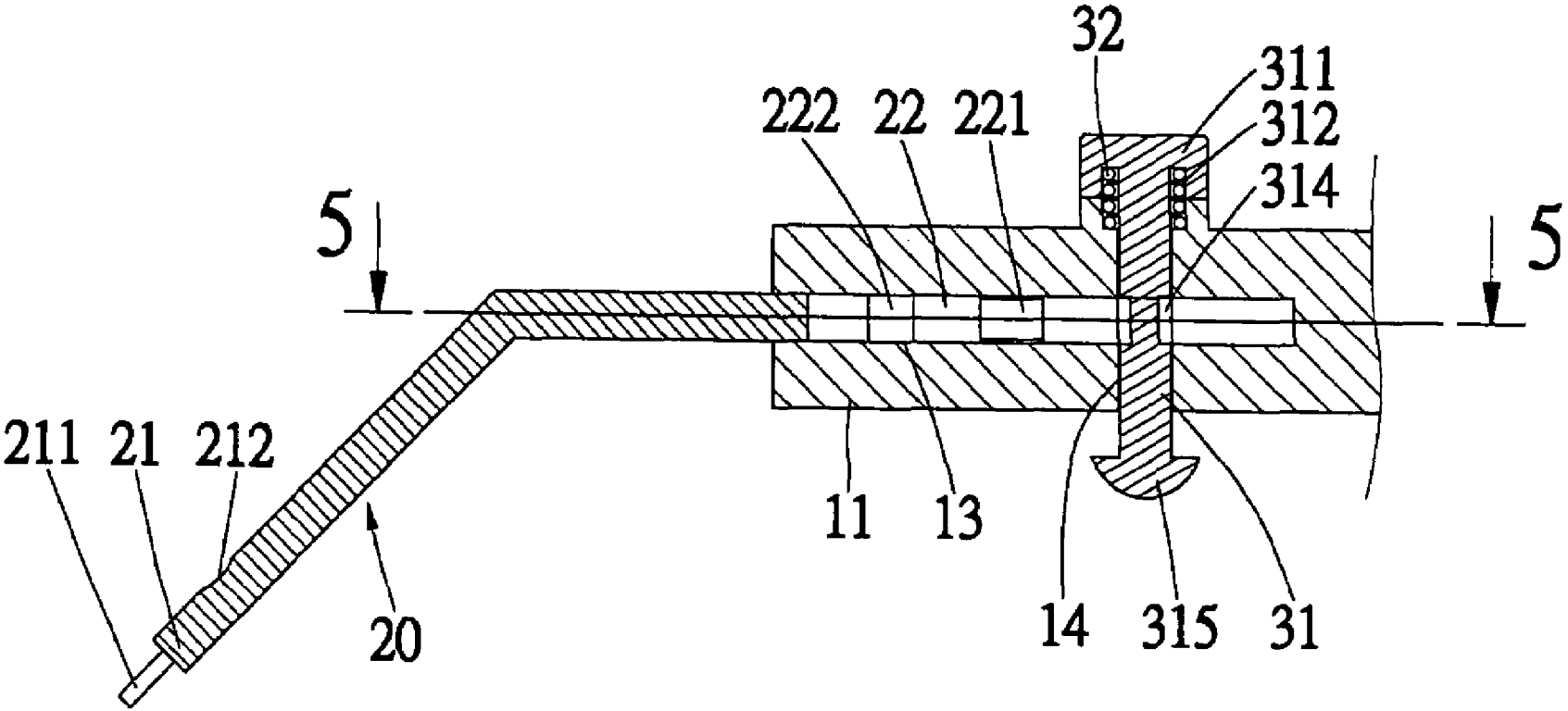
FIG. 6 is a cross-sectional view of the pair of pliers taken along a line 6—6 in FIG. 5.

Referring to FIGS. 5 and 6, the pin 31 is pushed at the first head 311 so that the waist 314 is aligned with the second operative portion 22 in order to allow the removal of the second operative portion 22 from the pocket 13.

Figure 7:
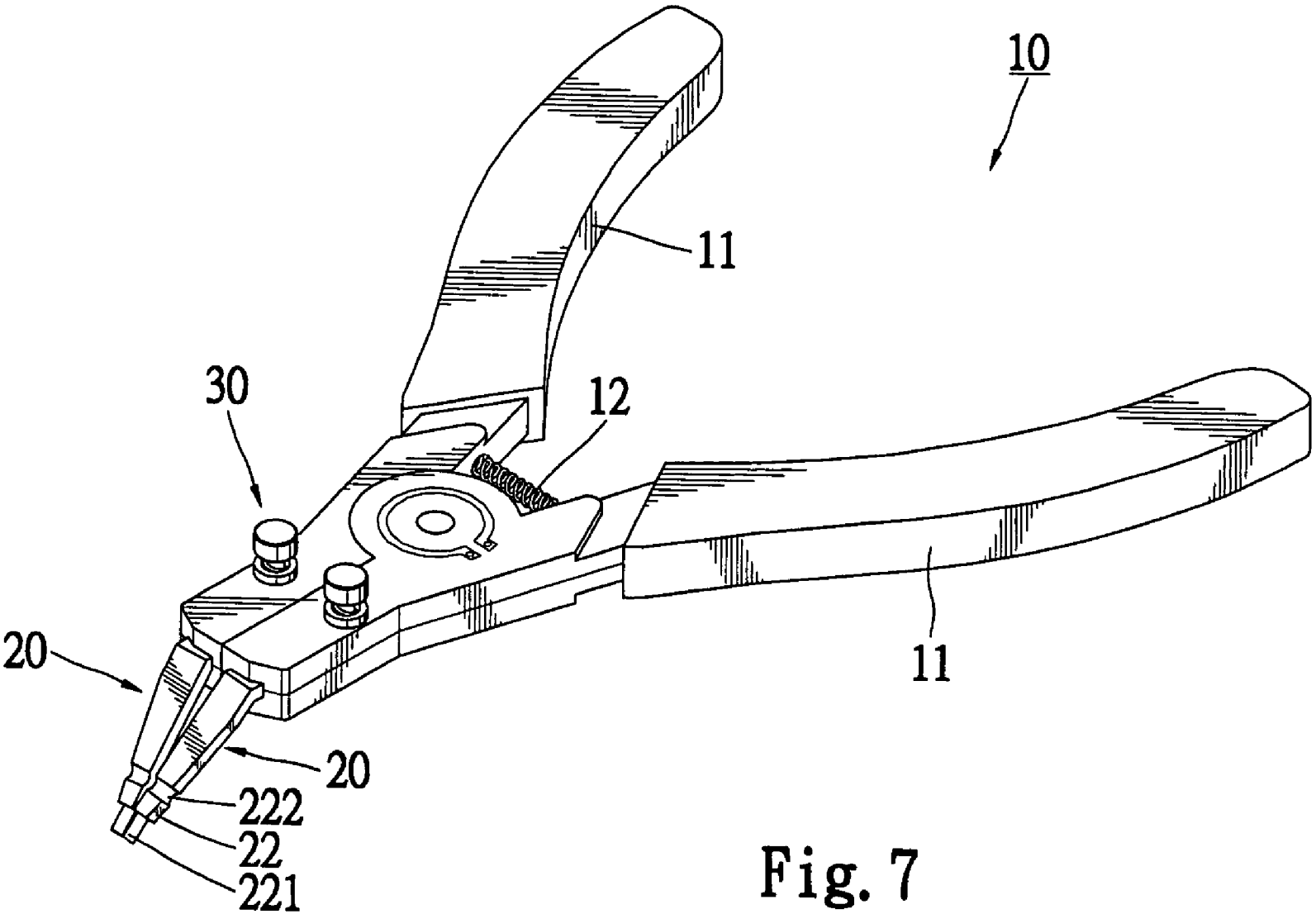
FIG. 7 is similar to FIG. 1 but shows the pair of pliers with different operative portions ready for use.
Figure 8:
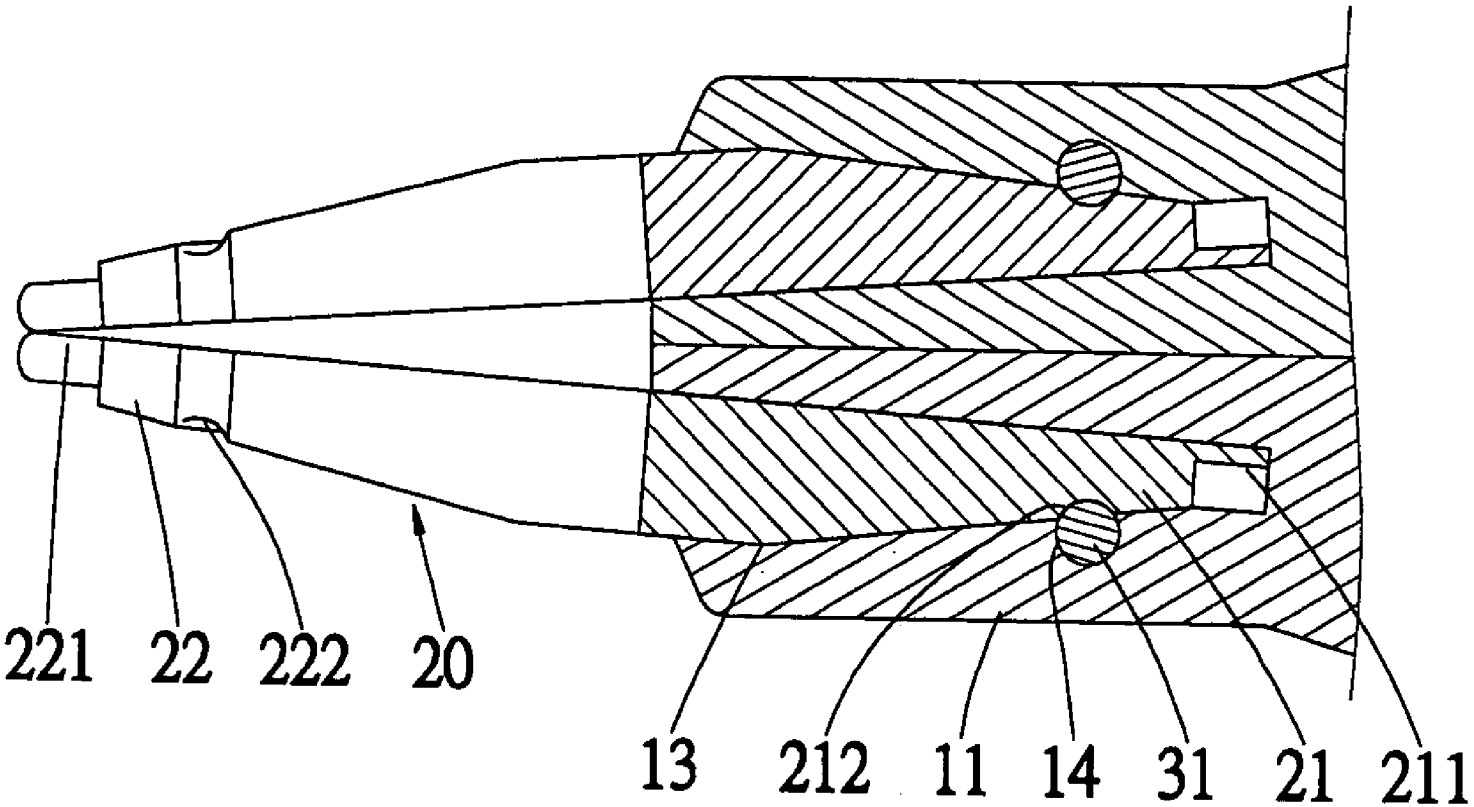
FIG. 8 is a cross-sectional view of the pair of pliers shown in FIG. 7.

Referring to FIGS. 7 and 8, the second operative portions 22 are exposed for use while the first operative portions 21 are kept in the pockets 13.

Figure 9:
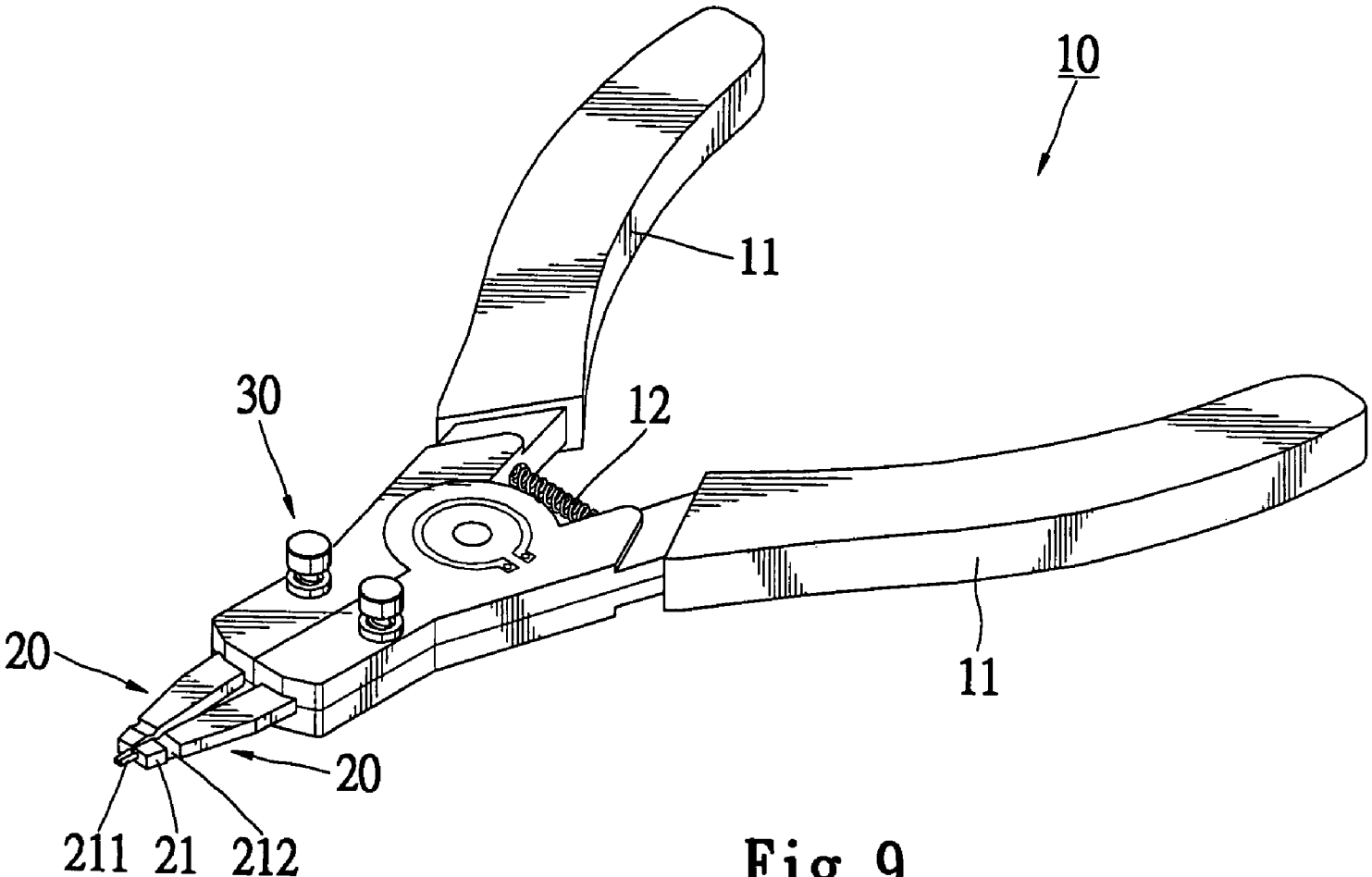
FIG. 9 is a perspective view of a pair of pliers for snap rings according to a second embodiment of the present invention.

FIG. 9 shows a pair of pliers for snap rings according to a second embodiment of the present invention. The second embodiment is identical to the first embodiment except that an angle of 180 degrees is defined between the first operative portion 21 and the second operative portion 22 of each jaw 20.

Figure 10:
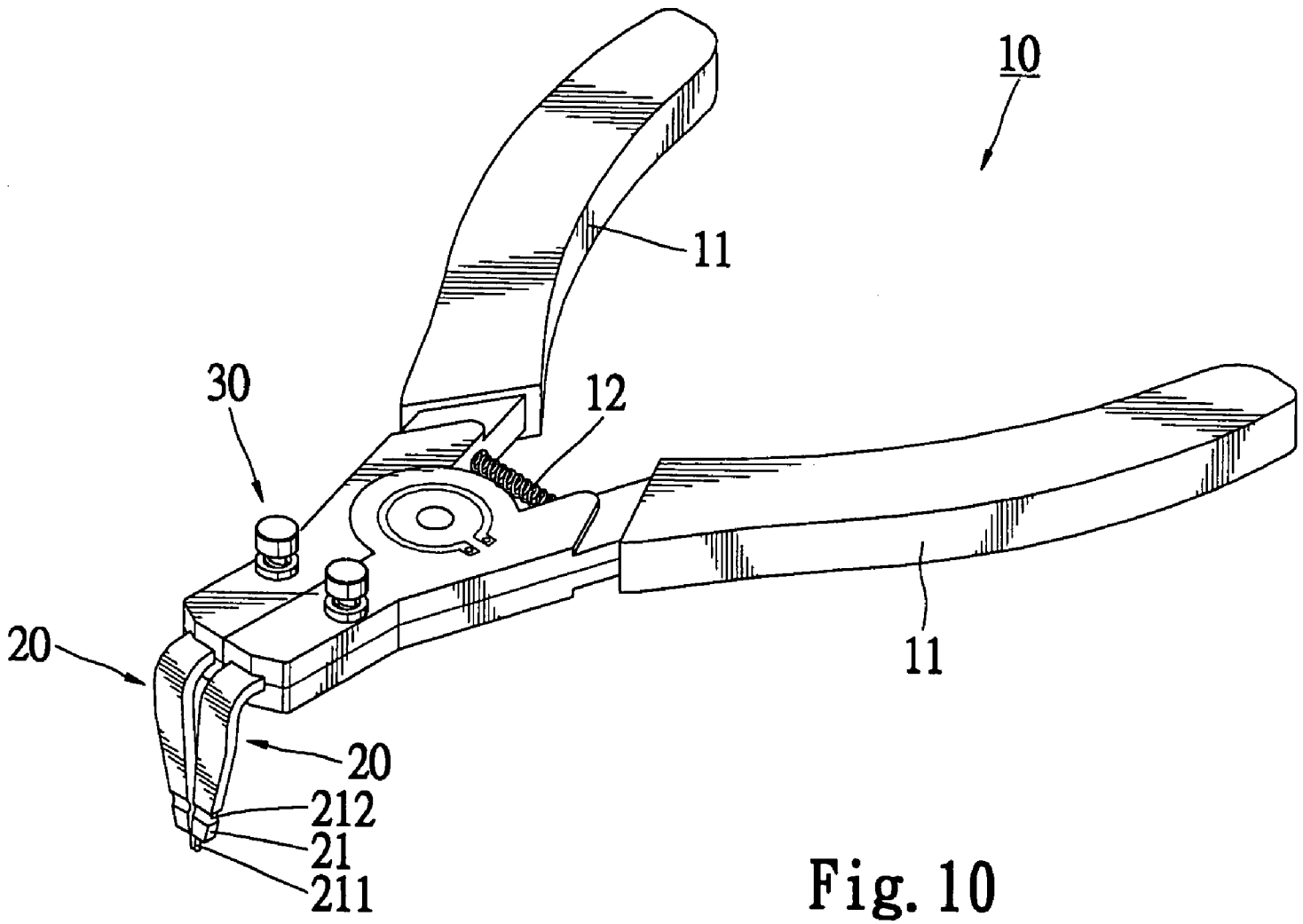
FIG. 10 is a perspective view of a pair of pliers for snap rings according to a third embodiment of the present invention.

FIG. 10 shows a pair of pliers for snap rings according to a third embodiment of the present invention. The third embodiment is identical to the first embodiment except that an angle of 90 degrees is defined between the first operative portion 21 and the second operative portion 22 of each jaw 20.

Figure 11:
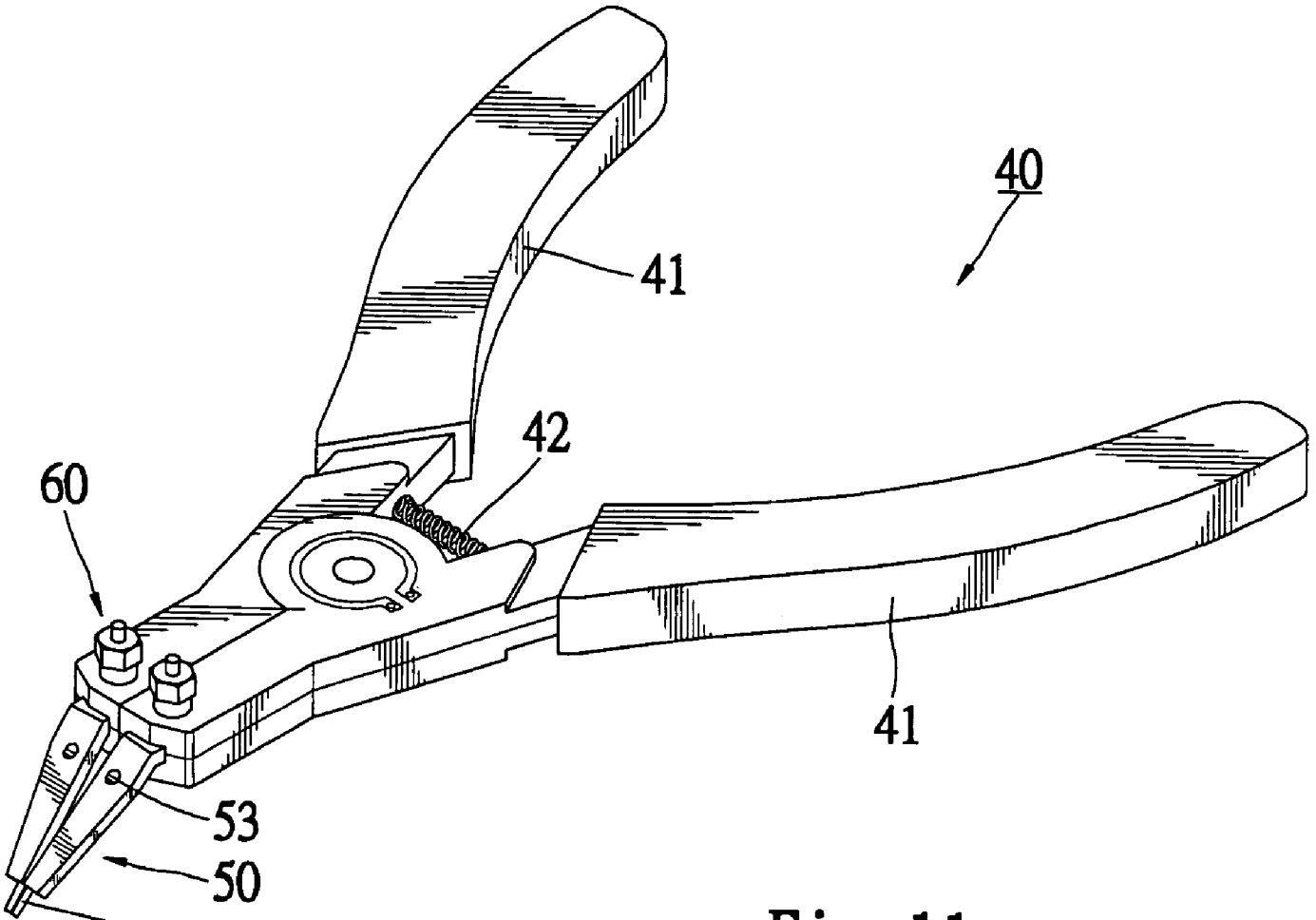
FIG. 11 is a perspective view of a pair of pliers for snap rings according to a fourth embodiment of the present invention.

Referring to FIG. 11, according to a fourth embodiment of the present invention, a pair of pliers 40 for snap rings includes two handles 41 pivotally connected with each other, a spring 42 compressed between the handles 41 and two jaws 50 installed on the handles 41 by quick release devices 60.

Figure 12:
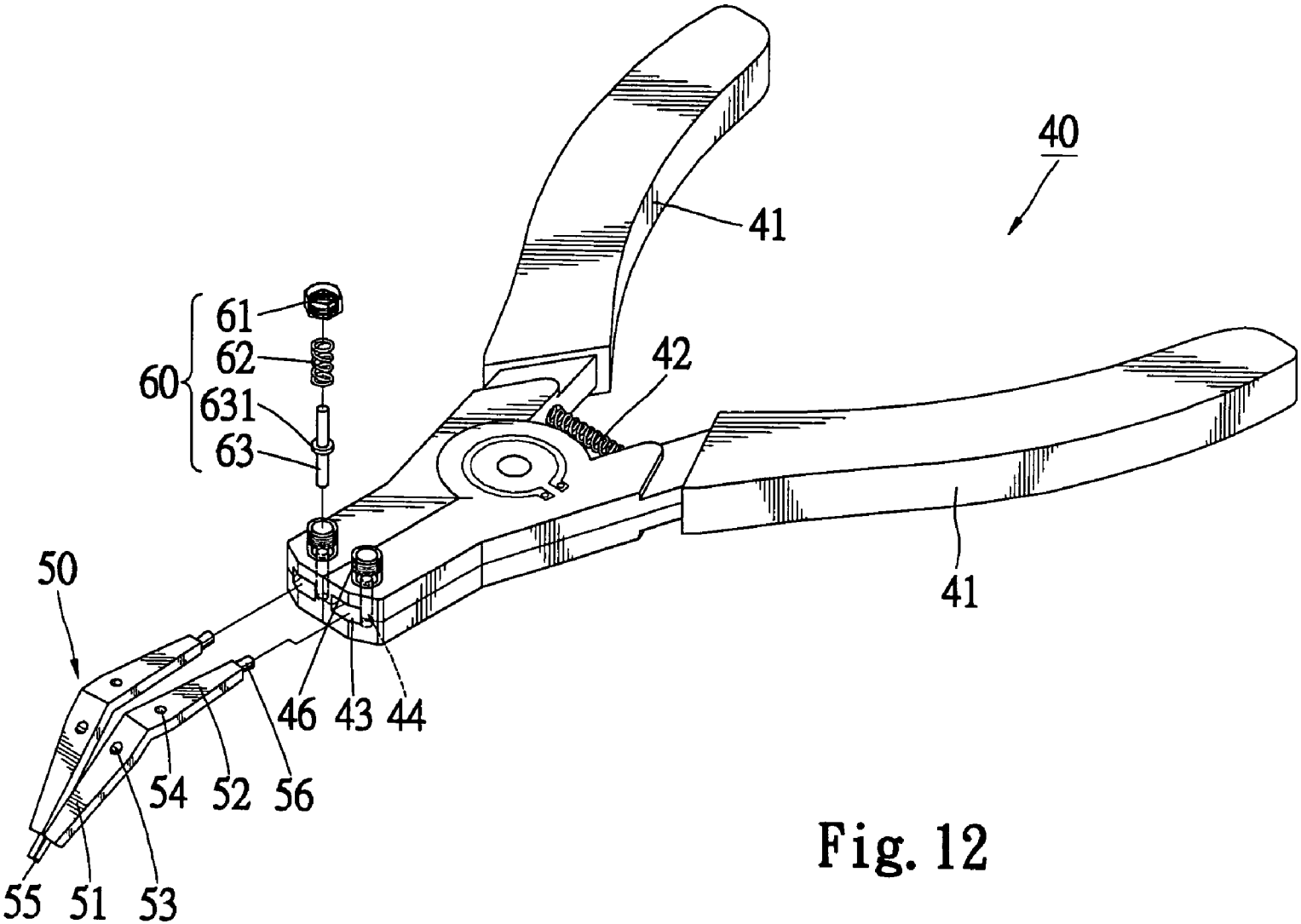
FIG. 12 is an exploded view of the pair of pliers shown in FIG. 11.

Referring to FIG. 12, each handle 41 defines a pocket 43 and an aperture 44 communicated with the pocket 43. A wall 46 is formed on each handle 41 around an end of the aperture 44. The wall 46 is formed with a thread.

Each jaw 50 includes a first operative portion 51 and a second operative portion 52 with an obtuse angle defined between the first operative portion 51 and the second operative portion 52. The first operative portion 51 includes a tip 55 formed at an end and an aperture 53 defined near the end. The second operative portion 52 includes a tip 56 formed at an end and an aperture 54 defined near the end. The size of the tip 55 is different from that of the tip 56. The second operative portions 52 are inserted in the pockets 43 so that the first operative portions 51 are exposed for use.

Figure 14:
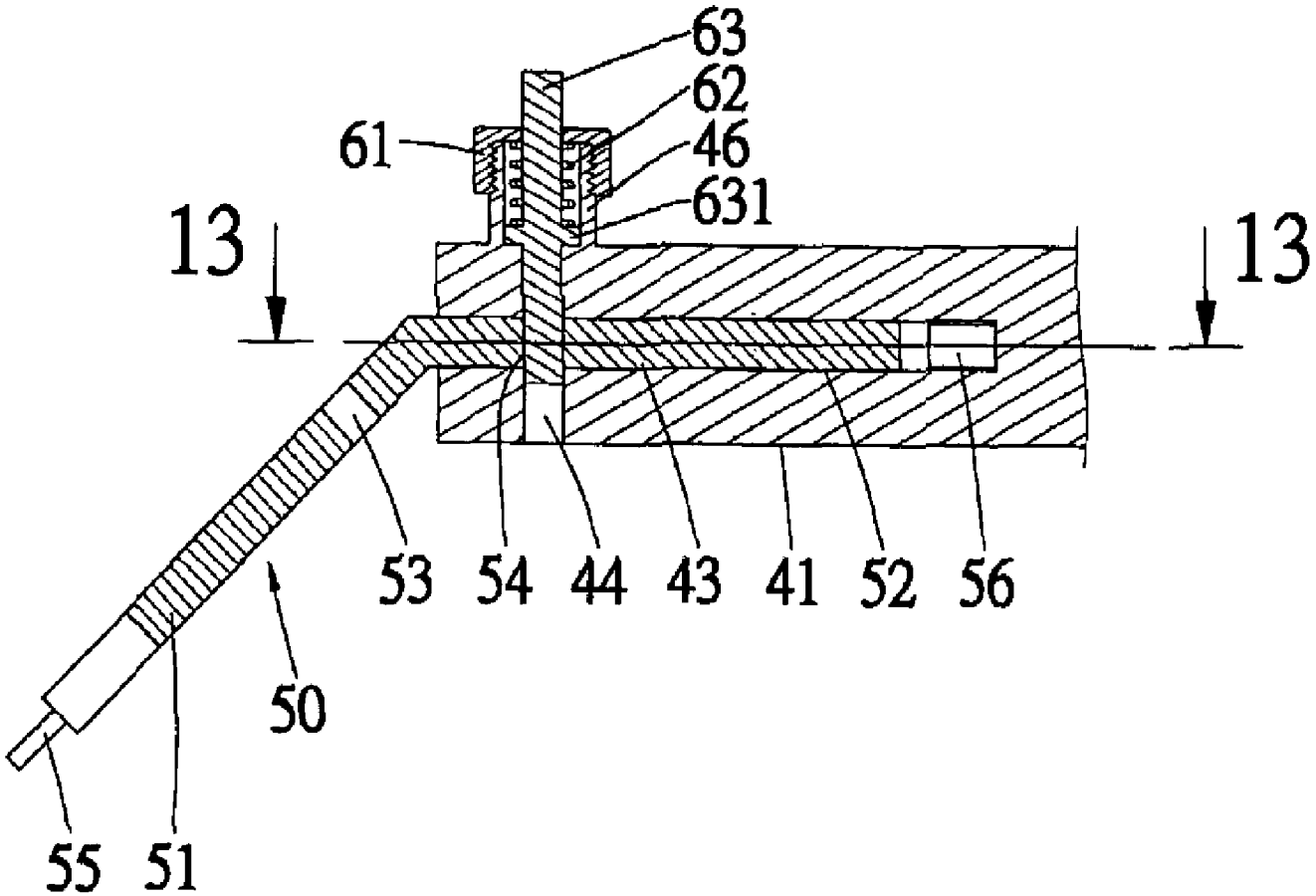
FIG. 14 is a cross-sectional view of the pair of pliers shown in FIG. 11 taken along a line 14—14 in FIG. 13.

Each quick release device 60 includes a ring 61, a spring 62 and a pin 63. The ring 61 is formed with a thread. The pin 63 includes a first portion, a second portion and an enlarged portion 631 formed between the first and second portions. The first portion of the pin 63 is inserted in the aperture 44 while the enlarged portion 631 is inserted in the wall 46. The thread of the ring 61 is engaged with the thread of the wall 46 so as to keep the pin 63 in position (FIG. 14). The second portion of the pin 63 is exposed.

Figure 13:
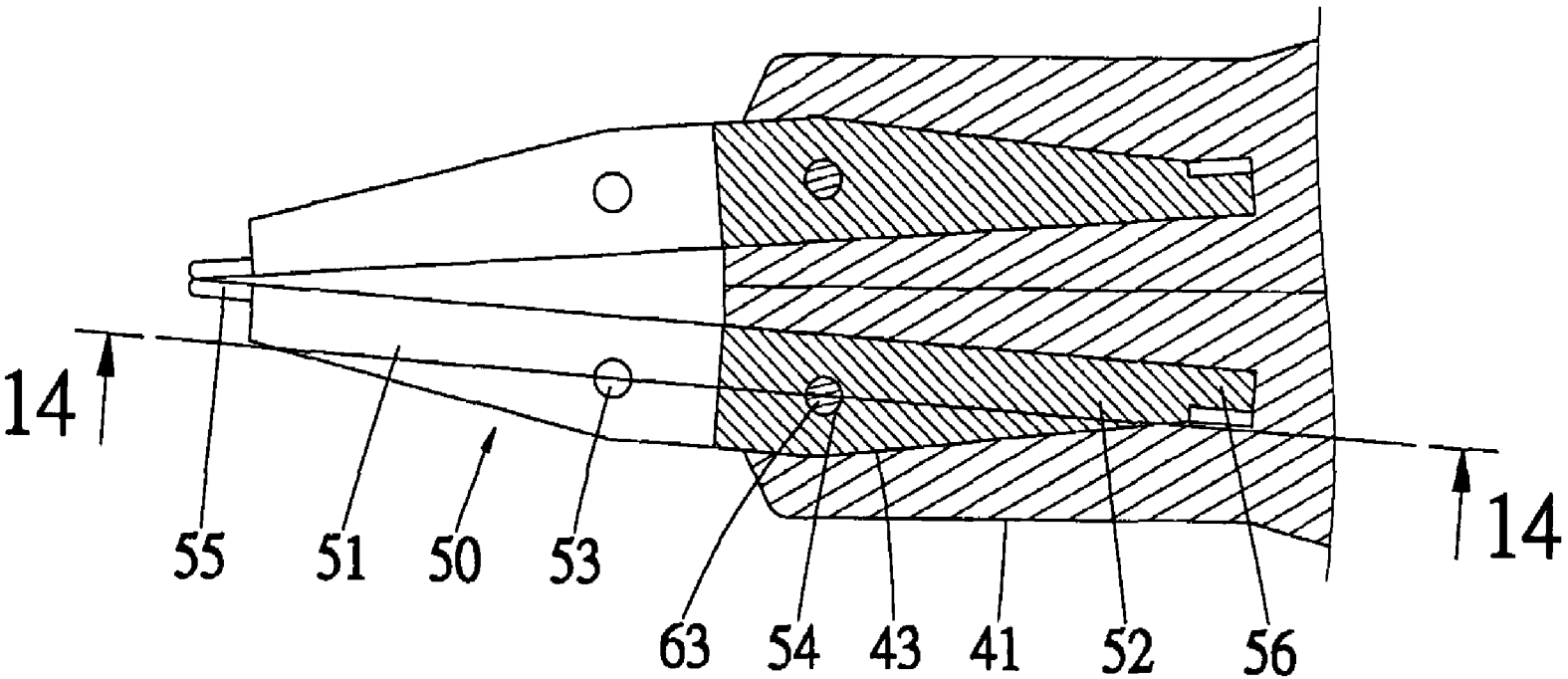
FIG. 13 is a cross-sectional view of the pair of pliers shown in FIG. 11 taken along a line 13—13 in FIG. 14.

Referring to FIGS. 13 and 14, the first portion of the pin 63 is inserted in the aperture 54 so that the second operative portion 52 is kept in the pocket 43.

Figure 15:
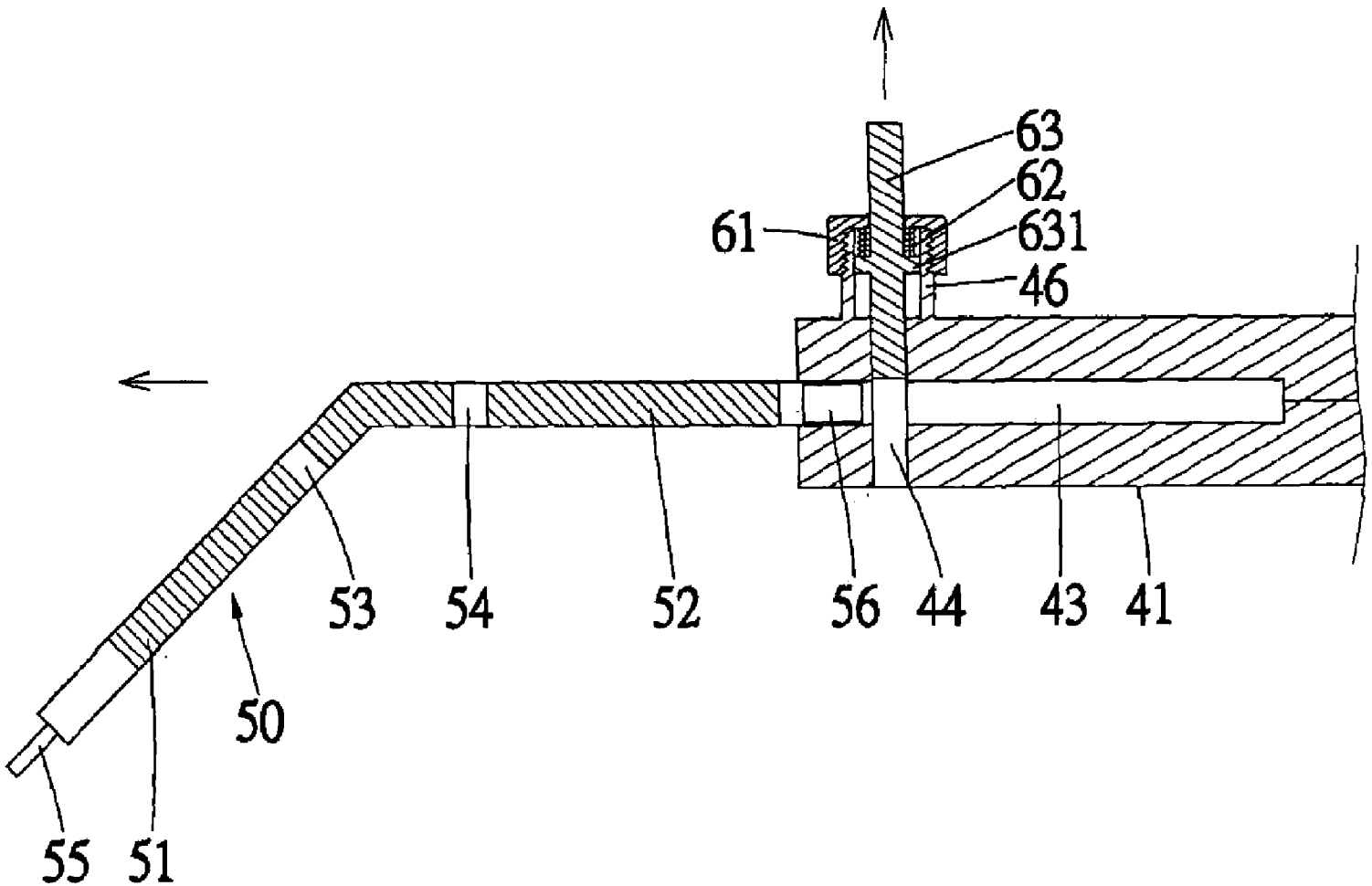
FIG. 15 is similar to FIG. 14 but shows the pair of pliers in a different position.

Referring to FIG. 15, the second portion of the pin 63 is pulled so that the first portion of the pin 63 is removed from the aperture 53 in order to allow the removal of the second operative portion 52 from the pocket 43.

The present invention has been described through detailed illustration of the embodiments. Those skilled in the art can derive variations from the embodiments without departing from the scope of the present invention. Therefore, the embodiments shall not limit the scope of the present invention defined in the claims.

What is claimed is:

1. A pair of pliers for snap rings, the pair of pliers comprising two handles pivotally connected with each other, a spring compressed between the handles and two jaws detachably installed on the handles, wherein each of the jaws comprises a first operative portion, a first tip extending from the first operative portion, a second operative portion and a second tip extending from the second operative portion, wherein the second tip is made with a size different from that of the first tip, wherein each of the handles defines a pocket for receiving selective one of the first and second operative portions of related one of the jaws.

2. The pair of pliers according to claim 1 wherein the first operative portion is at an obtuse angle from the second operative portion of each of the jaws.

3. The pair of pliers according to claim 1 wherein the first operative portion is at an angle of 180 degrees from the second operative portion of each of the jaws.

4. The pair of pliers according to claim 2 wherein the first operative portion is at the right angle from the second operative portion of each of the jaws.

5. The pair of pliers according to claim 1 comprising a quick-release device for locking each of the jaws to related one of the handles.

6. The pair of pliers according to claim 5 wherein each of the handles defines an aperture communicated with the pocket for receiving the quick release device.

7. The pair of pliers according to claim 6 wherein each of the first and second operative portions comprises a neck, wherein the quick release device comprises a pin with a waist, wherein the pin is movable in the aperture between a locking position where it engages with the neck and a releasing position where the waist aligns with selective one of the first and second operative portions.

8. The pair of pliers according to claim 7 wherein the pin comprises two heads formed thereon for keeping the pin in the aperture.

9. The pair of pliers according to claim 8 wherein the quick release device comprises a spring compressed between one of the heads and of the pin each of the handles.

10. The pair of pliers according to claim 9 wherein the head defines an annular groove for receiving the spring.

11. The pair of pliers according to claim 9 wherein each of the handles comprises a wall formed around the aperture for guiding the spring.

12. The pair of pliers according to claim 6 wherein each of the first and second operative portions defines an aperture, wherein the quick release device comprises a pin, wherein the pin is movable in the aperture between a locking position where it is inserted in the aperture of selective one of the first and second operative portions and a releasing position where it is removed from the aperture of selective one of the first and second operative portions.

13. The pair of pliers according to claim 12 wherein each of the handles comprises a wall formed around the aperture, wherein the pin comprises an enlarged portion, wherein the quick release device comprises a ring engaged with the wall for abutting the enlarged portion of the pin for keeping the pin in the aperture.

14. The pair of pliers according to claim 13 wherein the quick release device comprises a spring compressed between the ring and the enlarged portion of the pin.

* * * * *